US008134517B2

(12) United States Patent
Wang et al.

(10) Patent No.: US 8,134,517 B2
(45) Date of Patent: Mar. 13, 2012

(54) WIDE-BAND PLANAR ANTENNA

(75) Inventors: Chih-Ming Wang, Taipei (TW); Shang-Ching Tseng, Taipei (TW)

(73) Assignee: Wistron NeWeb Corp., Hsichih, Taipei (TW)

( * ) Notice: Subject to any disclaimer, the term of this patent is extended or adjusted under 35 U.S.C. 154(b) by 407 days.

(21) Appl. No.: 12/567,417

(22) Filed: Sep. 25, 2009

(65) Prior Publication Data

US 2010/0103069 A1 Apr. 29, 2010

(30) Foreign Application Priority Data

Oct. 28, 2008 (TW) ..... 97141365 A

(51) Int. Cl.
*H01Q 1/48* (2006.01)

(52) U.S. Cl. ..... 343/846

(58) Field of Classification Search ..... 343/846, 343/702, 700 MS, 848, 850, 853
See application file for complete search history.

(56) References Cited

U.S. PATENT DOCUMENTS

| | | | | |
|---|---|---|---|---|
| 6,373,436 | B1 * | 4/2002 | Chen et al. | 343/702 |
| 6,861,986 | B2 | 3/2005 | Fang et al. | |
| 7,218,282 | B2 * | 5/2007 | Humpfer et al. | 343/700 MS |
| 7,400,302 | B2 * | 7/2008 | Winter | 343/702 |
| 2005/0190110 | A1 * | 9/2005 | Taromaru et al. | 343/702 |
| 2011/0234470 | A1 * | 9/2011 | Chen | 343/895 |

FOREIGN PATENT DOCUMENTS

| | | |
|---|---|---|
| TW | I295517 | 4/2008 |
| TW | 200824189 | 6/2008 |

* cited by examiner

*Primary Examiner* — Huedung Mancuso
(74) *Attorney, Agent, or Firm* — Muncy, Geissler, Olds & Lowe, PLLC

(57) ABSTRACT

The invention relates to a wide-band planar antenna. The wide-band planar antenna includes a substrate, a first radiator, a second radiator, a third radiator, a ground, and a signal source. The first radiator, the second radiator, and the third radiator are designed in a manner that the antenna of the invention can be applied to WiMAX communication devices. Besides, the wide-band planar antenna of the invention is more efficient than a general wide-band antenna and saves a significant amount of electrical power, and therefore, the antenna is particularly suitable for portable communicational devices.

16 Claims, 11 Drawing Sheets

The third frequency band mode

The first frequency band mode

The second frequency band mode

The third frequency band mode

The first frequency band mode

The second frequency band mode

WIDE-BAND PLANAR ANTENNA

This application claims the priority based on a Taiwanese patent application No. 097141365, filed on Oct. 28, 2008, the disclosure of which is incorporated herein by reference in its entirety.

BACKGROUND OF THE INVENTION

1. Field of the Invention

The present invention relates to a wide-band antenna; more particularly, the present invention relates to a wide-band planar antenna for wireless network communications.

2. Description of the Prior Art

As the physical Internet becomes more and more popular, people pay much attention to a wireless, long-distance, and wide-band network in place of the physical Internet to increase the popularity in wideband communications. Thus, more advanced wireless communication network technologies and standards continuously emerge. For example, Wi-Fi wireless network standard is previously defined in IEEE 802.11 by Institute of Electrical and Electronics Engineers (IEEE); Worldwide Interoperability for Microwave Access (WiMAX) is recently defined in IEEE 802.16. Especially for WiMAX, the transmission distance has been increased from meters to kilometers, and the bandwidth becomes wider over the prior art.

In order to comply with the progress of wireless communication network technology, the antenna needs to be enhanced for receiving/transmitting wireless signals accordingly. FIG. 1 shows a traditional dual-band antenna disclosed in the U.S. Pat. No. 6,861,986. The dual-band antenna includes a first radiator 31 and a second radiator 32, both connected to a ground 4. Signals are fed through a feed-in point 61 directly to excite the first radiator 31 to generate a high frequency band mode, whose central operating frequency is about 5.25 GHz. The direct fed-in signal can also excite the second radiator 32 to generate a low frequency band mode, whose central operating frequency is about 2.45 GHz. Furthermore, the length of the second radiator 32 is about one quarter (¼) of the wavelength at its operating frequency.

Because the antenna is fed with signals in a direct-feed-in manner, the bandwidth of the low frequency band mode is about 200 MHz, which cannot satisfy WiMAX requirement. Furthermore, in order to meet the operating frequency of the low frequency band mode, the length of the second radiator 32 cannot be further reduced resulting in the restriction of miniaturization of the electronic devices.

SUMMARY OF THE INVENTION

It is an object of the present invention to provide a wide-band planar antenna to reduce required materials for same functional design and to significantly reduce the production cost.

It is another object of the present invention to provide a wide-band planar antenna having three different frequency bands through direct feed-in and coupling feed-in methods to accommodate the needs of different frequencies.

It is a further object of the present invention to provide a wide-band antenna, which prevents reflective waves in a specific bandwidth so as to enhance the power of electromagnetic waves and to save more electrical power compared with a general antenna.

The wide-band planar antenna of the invention includes a substrate, a first radiator, a second radiator, a third radiator, a ground, and a signal source. The substrate includes a first surface and a second surface corresponding to the first surface. In other words, the first surface and the second surface are two opposite surfaces of the substrate. The first radiator is disposed on the first surface. The second radiator connects to the first radiator at a connection part. The second radiator is disposed on either the first surface or the second surface. In other words, the second radiator and the first radiator can be disposed on a same surface or different surfaces of the substrate.

The third radiator is disposed on either the first surface or the second surface. In other words, the third radiator can be disposed on the first surface or the second surface in accordance with different designs or field patterns. The ground connects to the third radiator and includes a first ground part and a second ground part. The third radiator includes a shorter side and a longer side connected to the shorter side. The shorter side connects to the ground. A lengthwise direction of the shorter side is perpendicular to a lengthwise direction of the longer side. The longer side extends toward the first radiator. The second radiator is disposed between the third radiator and the ground.

The signal source feeds a high frequency signal including a positive signal and a negative signal. The positive signal is directly fed through the connection part to excite the first radiator and the second radiator to generate a first frequency band mode and a second frequency band mode respectively. The negative signal couples with the ground to be fed into and excite the third radiator to generate a third frequency band mode by a coupling effect.

DETAILED DESCRIPTION OF THE PREFERRED EMBODIMENT

It is an object of the invention to provide a wide-band planar antenna and a manufacture process thereof. By a smaller and thinner design, the production cost can be drastically decreased. By designing the radiator for a specific bandwidth, reflective waves can be reduced to increase the power of electromagnetic waves so as to save more electrical power. In an embodiment, a wide-band planar antenna has a wireless communication function applicable to various electronic devices. The electronic devices preferably include laptops, desktop computers, motherboards, mobile phones, personal digital assistants, global positioning systems, electronic game devices, and so on. The wireless signal transmitted/received by the wide-band planar antenna can be applied to wireless local area network (WLAN), WiMAX, and other wireless communication protocols or standards.

Figure 1:
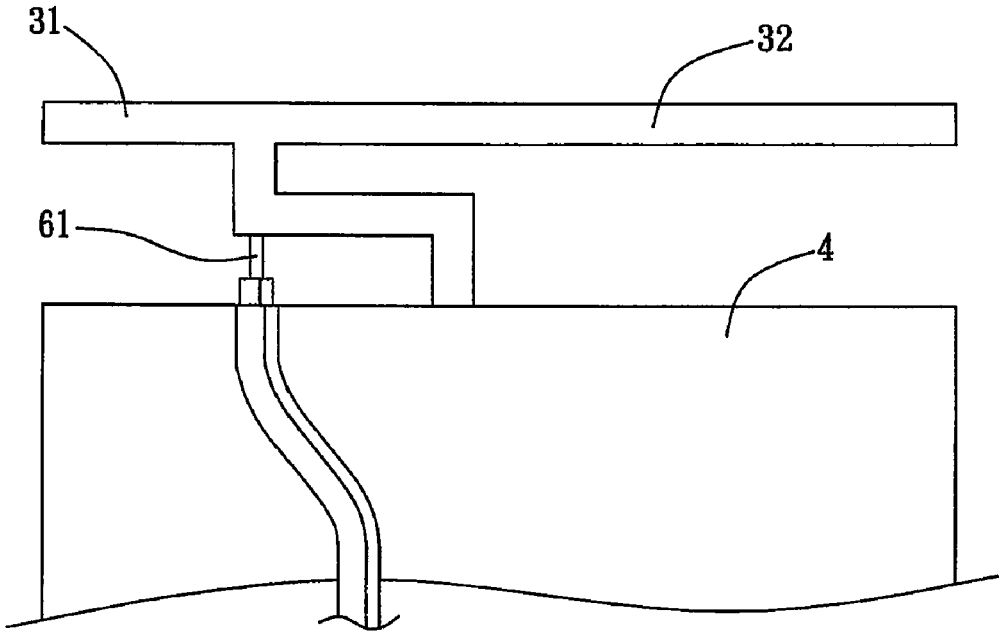
FIG. 1 (PRIOR ART)
FIG. 1 shows a schematic view of a traditional dual-band antenna.
Figure 2A:
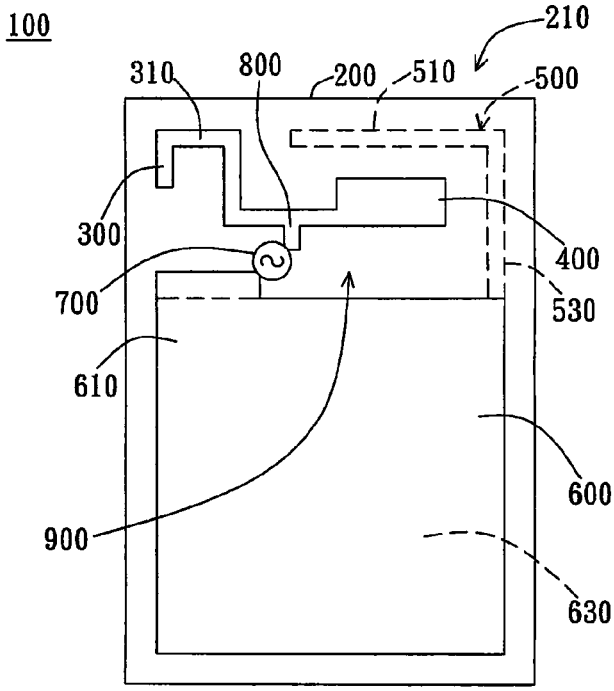
FIG. 2A shows a schematic view of a first surface of an antenna in accordance with an embodiment of the invention.
Figure 2B:
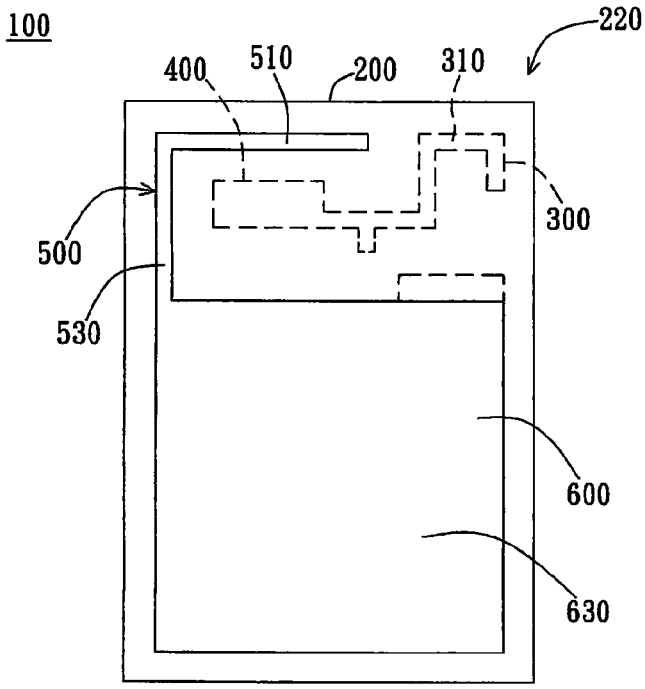
FIG. 2B shows a schematic view of a second surface of FIG. 2A.

FIG. 2A and FIG. 2B show schematic views of the wide-band antenna of the invention. With reference to FIG. 2A and FIG. 2B, the wideband planar antenna 100 includes a substrate 200, a first radiator 300, a second radiator 400, a third radiator 500, a ground 600, and a signal source 700. The substrate 200 is preferably made of polyethylene terephthalate (PET) or other dielectric materials. For example, a printed circuit board (PCB) or a flexible printed circuit board (FPCB) can be used as the substrate 200. In the embodiment, the thickness of the substrate 200 is less than, but not limited to, 1 mm. The substrate 200 includes a first surface 210 and a second surface 220 corresponding to the first surface 210. FIG. 2A shows a schematic view of the first surface 210 of the antenna. FIG. 2B shows a schematic view of the second surface 220 of the antenna.

With reference to FIG. 2A, the first radiator 300 is disposed on the first surface 210 of the substrate 200. In the embodiment, the first radiator 300 is disposed on the first surface 210 as a metal strip or a metal microstrip in other geometric shapes. The first radiator 300 is preferably printed on the first surface 210; however, in other embodiments, the first radiator 300 can be disposed by other processes. Furthermore, the area and the shape of the first radiator 300 can be adjusted according to the impedance matching design.

Figure 4A:
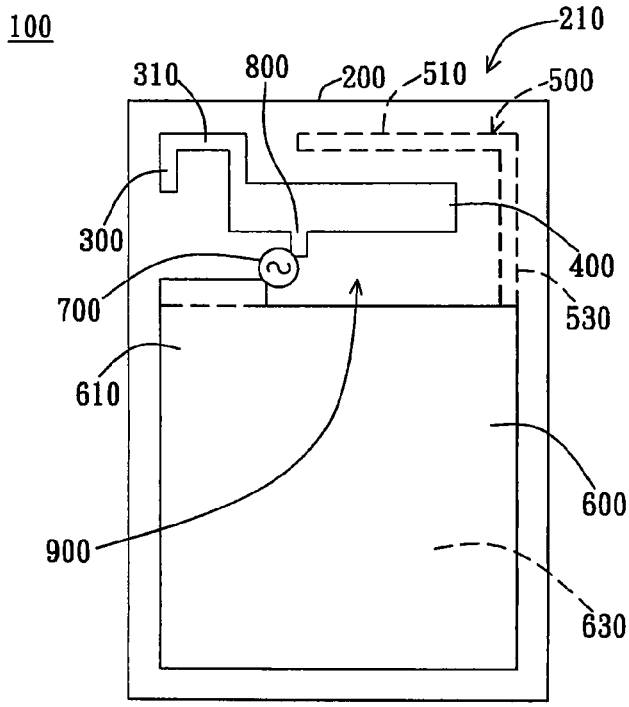
FIG. 4A shows a schematic view of a first surface of an antenna in accordance with an embodiment of the invention.
Figure 4B:
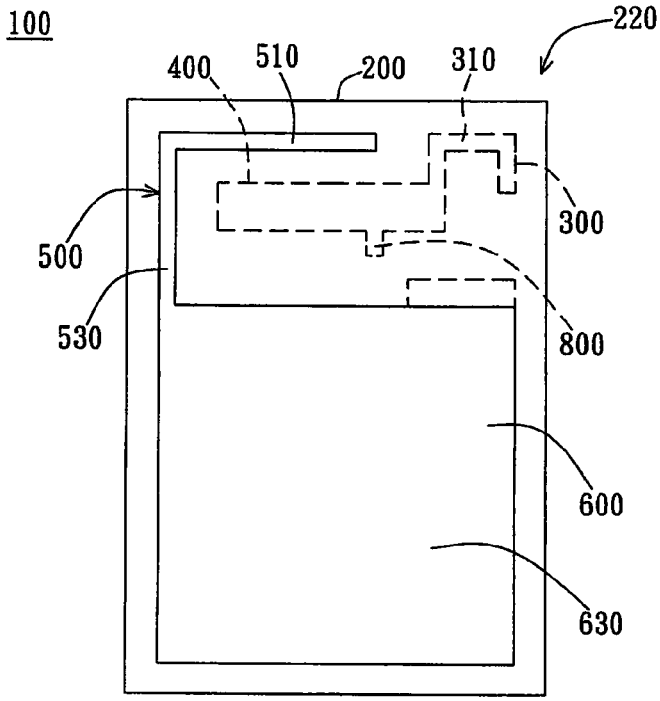
FIG. 4B shows a schematic view of a second surface of FIG. 4A.

The second radiator 400 connects to the first radiator 300 at a connection part 800. The second radiator 400 is preferably disposed on the first surface 210; however, in another embodiment, the second radiator 400 can be disposed on the second surface 220. In other words, the first radiator 300 and the second radiator 400 can be disposed on different surfaces. In such a case, the connection part 800 can penetrate the substrate 200 to connect to the first radiator 300 on the first surface 210 and to the second radiator 400 on the second surface 220. The second radiator 400 is preferably printed as a metal strip or a metal microstrip in other geometric shapes. In the embodiment shown in FIG. 4A and FIG. 4B, the area and the shape of the second radiator 400 can be adjusted according to the impedance matching design.

Figure 7A:
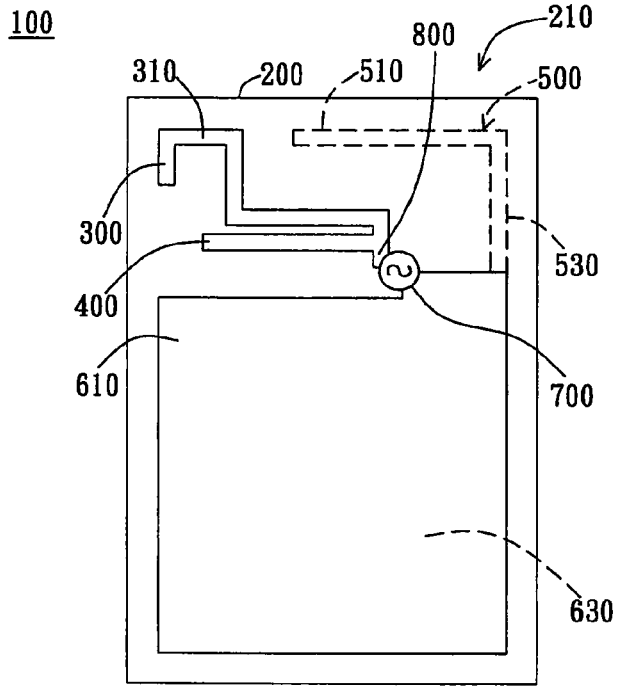
FIG. 7A shows a schematic view of a first surface of an antenna in accordance with an embodiment of the invention.
Figure 7B:
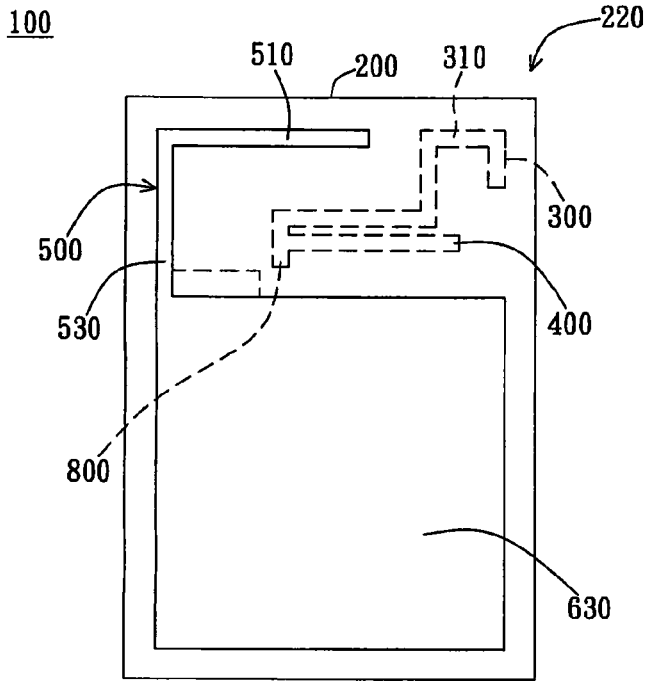
FIG. 7B shows a schematic view of a second surface of FIG. 7A.

In the embodiment shown in FIG. 2A and FIG. 2B, the second radiator 400 and the first radiator 300 are disposed on a same surface, i.e., the first surface 210. For example, the first radiator 300 and the second radiator 400 are two opposite ends of a same metal microstrip. However, in another embodiment, the first radiator 300 and the second radiator 400 are disposed on different surfaces, for example, the first surface 210 and the second surface 220 respectively. In such a case, the first radiator 300 and the second radiator 400 are distanced by the thickness of the substrate 200. In the embodiment, when the second radiator 400 is disposed on the second surface 220, the projection area of the second radiator 400 does not overlap with the first radiator 300. In the embodiment shown in FIG. 2A and FIG. 2B, the second radiator 400 extends away from the first radiator 300. However, in another embodiment shown in FIG. 7A and FIG. 7B, the second radiator 400 and the first radiator 300 can extend toward the same direction.

Figure 9A:
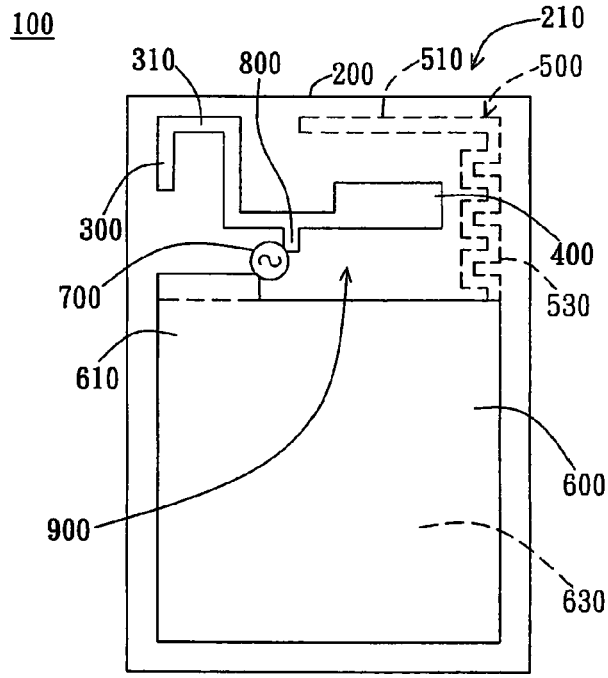
FIG. 9A shows a schematic view of a first surface of an antenna in accordance with an embodiment of the invention.
Figure 9B:
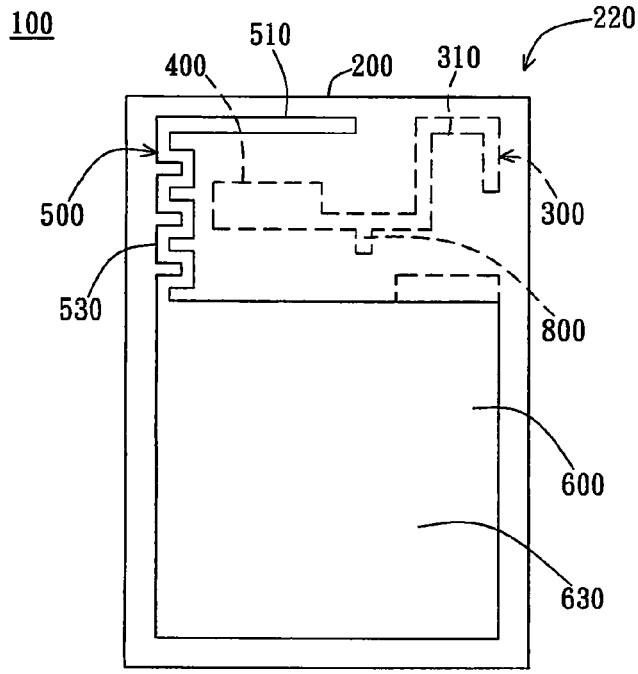
FIG. 9B shows a schematic view of a second surface of FIG. 9A.

The third radiator 500 can be disposed on the first surface 210 or the second surface 220 of the substrate 200. The third radiator 500 is preferably printed as a metal strip or a metal microstrip. The area and the shape of the third radiator 500 can be adjusted according to the impedance matching design. In the embodiment shown in FIG. 2A and FIG. 2B, the third radiator 500 is disposed on the second surface 220 and extends toward the first radiator 300. The third radiator 500 is disposed on the surface where the first radiator 300 and the second radiator 400 are not disposed. In the embodiment shown in FIG. 2A and FIG. 2B, the third radiator 500 includes a longer side 510 and a shorter side 530. A lengthwise direction of the shorter side 530 is perpendicular to a lengthwise direction of the longer side 510. In other words, a right angle is formed between the shorter side 530 and the longer side 510. The third radiator 500 connects the ground 600 through the shorter side 530. The connecting method includes coupling, welding, and metal printing. The third radiator 500 preferably extends in a direction away from the ground 600. In the embodiment, the shorter side 530 of the third radiator 500 is distributed on the substrate 200 in a zigzag manner, such as the shorter side 530 shown in FIG. 9A and FIG. 9B. In such an arrangement, it is possible to increase a path length of the third radiator 500 so as to increase or change the bandwidth of the third frequency band mode without requiring additional space. Therefore, the bandwidth of a larger antenna can be achieved by a smaller antenna resulting in the size reduction of the antenna.

The ground 600 includes a first ground part 610 and a second ground part 630. In the embodiment shown in FIG. 2A and FIG. 2B, the third radiator 500 connects to the second ground part 630. The second ground part 630 and the third radiator 500 are disposed on the second surface 220. Because the shorter side 530 connects to the second ground part 630 and intersects with the longer side 510, the longer side 510 extends toward the first radiator 300. In the embodiment, the first ground part 610 and the second ground part 630 are disposed on the first surface 210 and the second surface 220, respectively. The first ground part 610 and the second ground part 630 are two metal pieces connected to form the ground 600. However, in other embodiments, the first ground part 610 and the second ground part 630 can be disposed independently as two grounding points. For example, the first ground part 610 can indirectly connect to the second ground part 630 when the two ground parts are disposed on two different surfaces. Furthermore, the antenna can achieve a better performance when the second ground part 630 and the first ground part 610 are disposed on different surfaces of the substrate 200 and indirectly connected to each other.

In the embodiment shown in FIG. 2A and FIG. 2B, the projection areas of the third radiator 500 and the first ground part 610 on the first surface 210 encircles a semi-open region 900. The second radiator 400 partially extends into the semi-open region 900. In other words, the second radiator 400 is disposed between the third radiator 500 and the ground 600. The semi-open region 900 of the embodiment is a region in a long strip shape. The second radiator 400 extends along the long strip region. Moreover, the first radiator 300 extends from the connection part 800 and opposite to the semi-open region 900. In other words, the second radiator 400 extends away from the first radiator 300. For space utilization, one end of the first radiator 300 extending outside the semi-open region 900 forms a bending part 310. The bending part 310 is bent and then extends toward the first ground part 610. In other words, the first radiator 300 extends from the connection part 800 in a direction away from the second radiator 400 and includes the bending part 310 extending toward the ground 600. However, in another embodiment, the first radiator 300 can directly extend without bending. Furthermore, in other embodiment, an extending end of the bending part 310 in the first radiator 300 can be bent to face the longer side 510 (not shown).

In the embodiment shown in FIG. 2A and FIG. 2B, the semi-open region 900 is defined by the ground 600, the shorter side 530, and the longer side 510. The shorter side 530 and the longer side 510 form a reversed L shape to connect to the ground 600. Because of the reversed L shape design, the size of the wideband antenna can be reduced to save the required space. However, in other embodiments, the third radiator 500 can be a reversed F shape, an S shape, or other geometric shapes.

The signal source 700 feeds signals into the wideband planar antenna 100 to excite the first radiator 300 and the second radiator 400 for generating wireless frequency band modes. With reference to FIG. 2A and FIG. 2B, the signal feed-in method of the wideband planar antenna of the invention are a direct feed-in method and a coupling method. The signal source 700 feeds a high frequency signal including a positive signal and a negative signal. The positive signal is directly fed through the connection part 800 to excite the first radiator 300 and the second radiator 400 to generate a first frequency band mode 730 and a second frequency band mode 750, respectively. The negative signal couples with the ground 600 to excite the third radiator 500 to generate a third frequency band mode 770 by coupling effect. Particularly, the feed-in location of the positive signal of the signal source 700 connects to the connection part 800, while the negative signal feed-in location couples with the first ground part 610. The second ground part 630 indirectly connects to the first ground part 610. The second radiator 400 is disposed within the semi-open region 900 encircled by the longer side 510, the shorter side 530, and the first ground part 610 of the ground 600. The positive signal feed-in location of the signal source 700 (i.e. the connection part 800) is disposed outside the semi-open region 900. However, in other embodiments, the arrangement of the metal strip can be adjusted in accordance with different designs and field patterns.

Figure 3A:
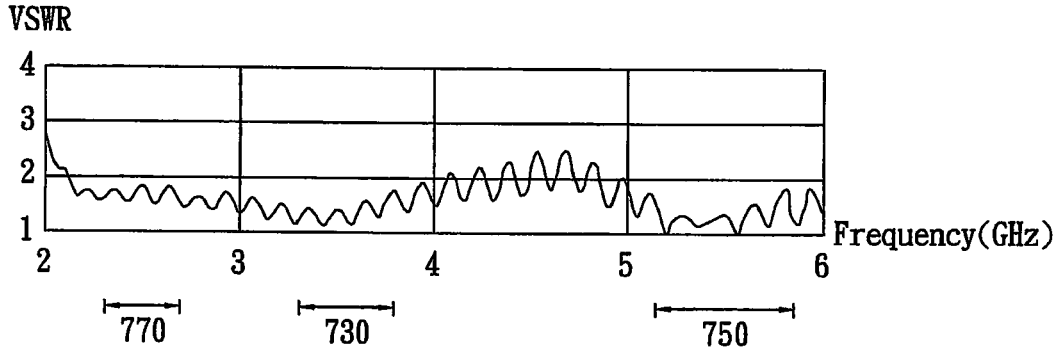
FIG. 3A shows a schematic view of a voltage standing wave ratio (VSWR) diagram of the embodiment illustrated in FIG. 2A.

FIG. 3A shows a schematic view of a voltage standing wave ratio (VSWR) diagram of the invention. In the embodiment, with the reference to FIG. 3A, the first frequency band mode 730 is a second high frequency band mode. The first frequency band mode preferably has a frequency band between 3.3 GHz and 3.8 GHz. The second frequency band mode 750 is a first high frequency band mode and preferably has a frequency band between 5.15 GHz and 5.85 GHz. In the embodiment, the VSWR of the first frequency band mode 730 and the second frequency band mode 750 can be controlled fewer than 2. In the embodiment shown in FIG. 3A, the third frequency band mode 770 is a low frequency band mode and preferably has a frequency band between 2.3 GHz and 2.7 GHz. In the embodiment, the VSWR of the third frequency band mode 770 can be controlled fewer than 2. The above-identified frequency band is an exemplary portion of the actual frequency band in the third frequency band mode 770. With reference to FIG. 3A, because the third frequency band mode 770 is generated by a coupling-feed-in manner, the actual frequency band thereof exceeds the above-identified range. Consequently, the first frequency band mode 730 partially overlaps with the third frequency band mode 770, but the first frequency band mode 730 does not overlap with the second frequency band mode 750. Besides, in the embodiment, the first frequency band mode 730 overlaps with the third frequency band mode 770 to form a broader frequency band. In other words, with reference to FIG. 3A, because the first frequency band mode 730 partially overlaps with the third frequency band mode 770, possible wave peaks generated in these modes may be eliminated and the VSWR may be controlled under 2, and therefore, the overall frequency band may be considered as the combination of the frequency bands of the first frequency band mode 730 and the third frequency band mode 770.

Figure 3B:
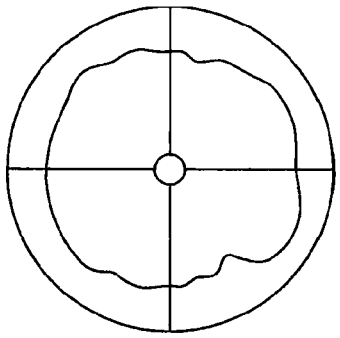
FIG. 3B shows a schematic view of a field pattern of FIG. 2A.
Figure 3B:
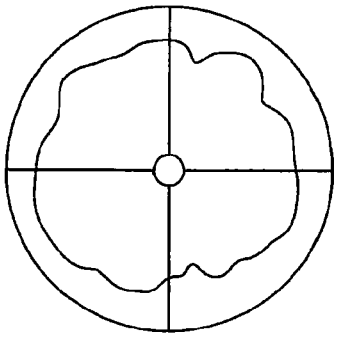
Figure 3B:
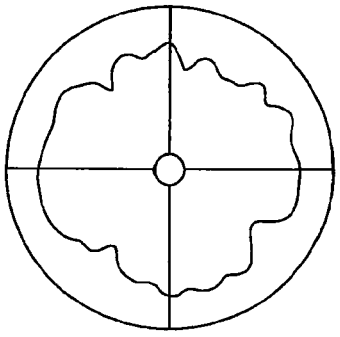

In the embodiment shown in FIG. 3A, the first frequency band mode 730 has a frequency band between 3.3 GHz and 3.8 GHz, and the field pattern of the first frequency band mode 730 is illustrated in FIG. 3B. The second frequency band mode 750 has a frequency band between 5.15 GHz and 5.85 GHz, and the field pattern of the second frequency band mode 750 is illustrated in FIG. 3B. The third frequency band mode 770 has a frequency band between 2.3 GHz and 2.7 GHz, and the field pattern of the third frequency band mode 770 is illustrated in FIG. 3B. The above-mentioned field patterns are characterized in that there is no free field effect (where a recess is formed in the field pattern and the radiation power is extremely low) in East, South, West, and, North directions.

Figure 5A:
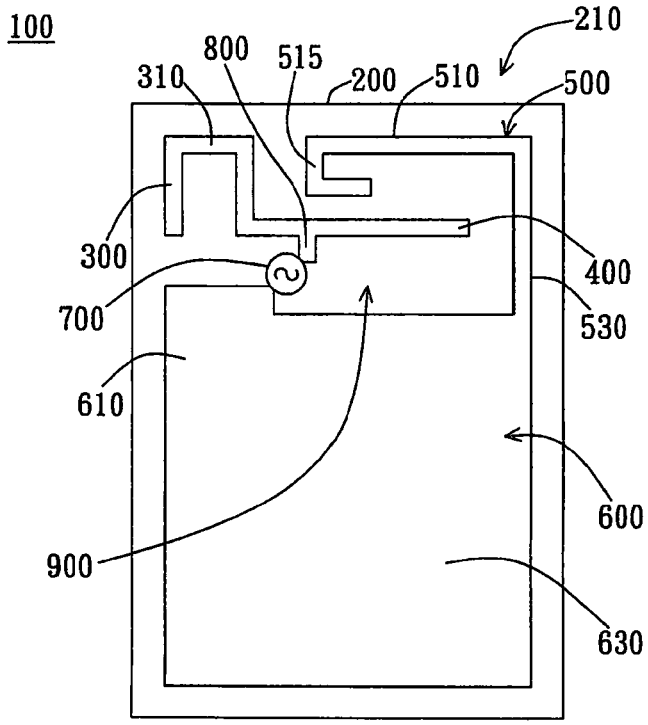
FIG. 5A shows a schematic view of a first surface of an antenna in accordance with an embodiment of the invention.
Figure 5B:
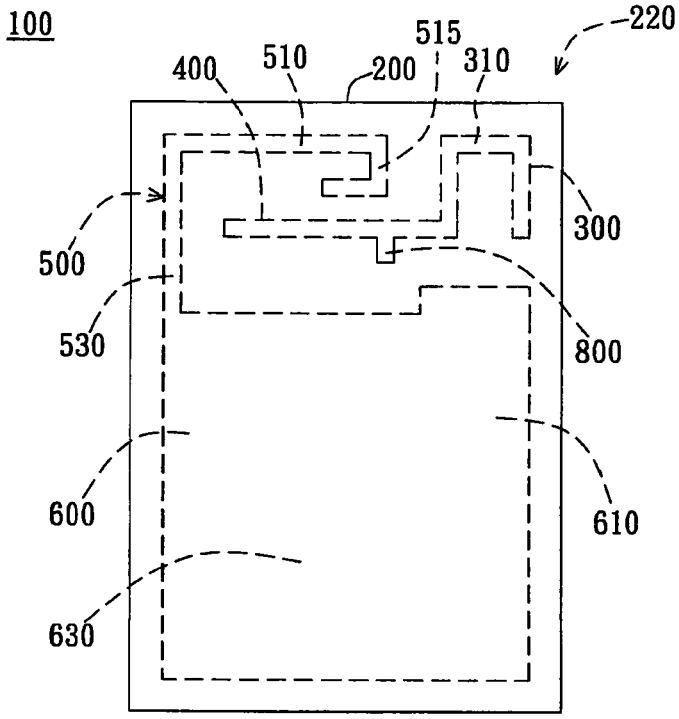
FIG. 5B shows a schematic view of a second surface of FIG. 5A.
Figure 8A:
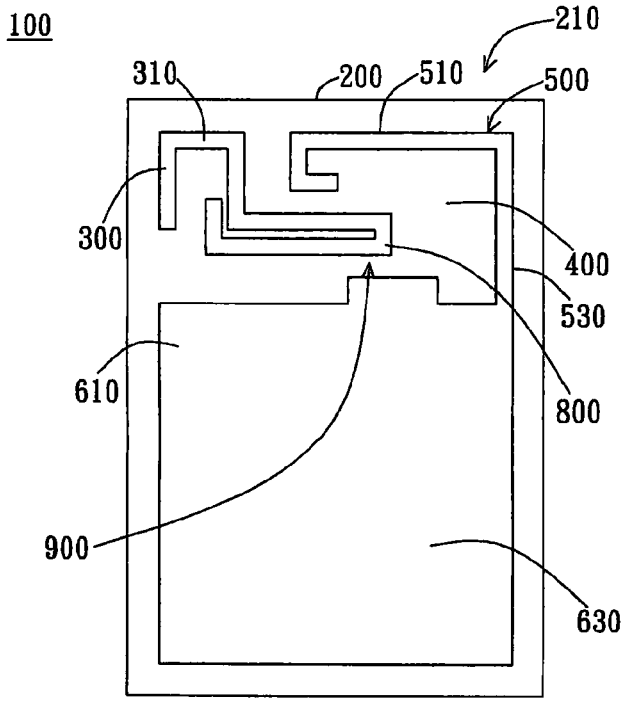
FIG. 8A shows a schematic view of a first surface of an antenna in accordance with an embodiment of the invention.
Figure 8B:
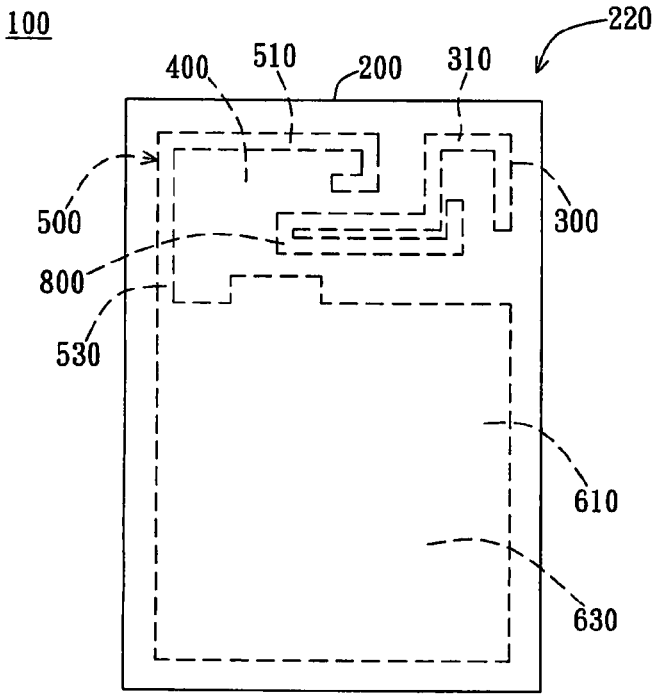
FIG. 8B shows a schematic view of a second surface of FIG. 8A.

In the embodiment shown in FIG. 5A and FIG. 5B, the extending end 515 of the longer side 510 of the third radiator 500 is bent toward the shorter side 530. In the embodiment, the first radiator 300, the second radiator 400, the third radiator 500, and the ground 600 are disposed on the first surface 210. In other words, the second surface 220 does not have any metal strip or metal microstrip. Because of the bend of the extending end 515 and the arrangement of the radiators on the same surface, it is allowed to maintain 50% power and not to create any free field effect. In the embodiment, the shorter side 530 of the third radiator 500 connects to the second ground part 630. The second ground part 630 and the first ground part 610 are formed as a metal piece disposed on the first surface 210 so that the second ground part 630 and the first ground part 610 are combined as an integrated ground 600. In the embodiment, the second radiator 400 extends into the semi-open region 900 in a direction away from the first radiator 300. In other words, the free ends of the first radiator 300 and the second radiator 400 extend away from each other. Besides, the second radiator 400 is disposed within the semi-open region 900 encircled by the longer side 510, the short side 530, and the ground 600. However, in another embodiment, the free ends of first radiator 300 and the second radiator 400 can extend toward the same direction, as shown in FIG. 8A and FIG. 8B. In the embodiment shown in FIG. 5A and FIG. 5B, the first radiator 300, the second radiator 400, and the third radiator 500 are preferably printed as metal strips or metal microstrips. The area or the shape of the first radiator 300, the second radiator 400, and the third radiator 500 can be adjusted in accordance with the impedance matching design. In the embodiment, the shorter side 530 of the third radiator 500 can be distributed on the substrate 200 in a zigzag manner, such as the shorter side 530 shown in FIG. 9A and FIG. 9B.

Figure 6A:
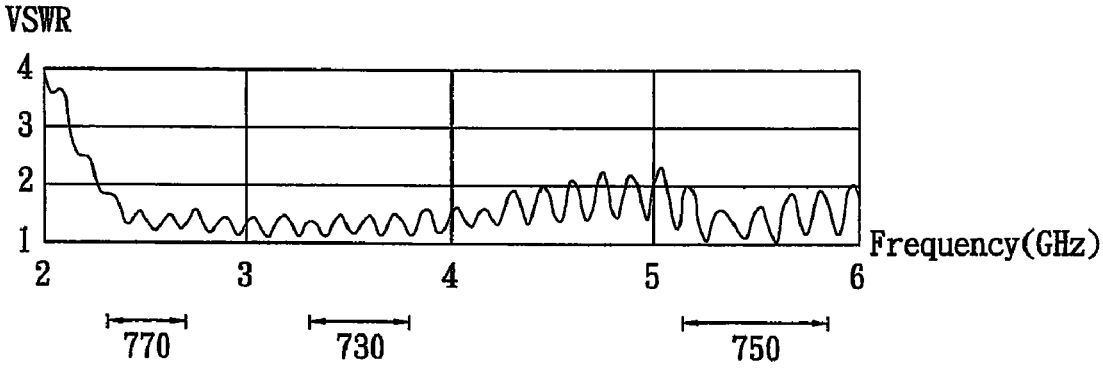
FIG. 6A shows a schematic view of a VSWR diagram of the embodiment illustrated in FIG. 5A.

FIG. 6A shows a schematic view of a VSWR diagram of the embodiment illustrated in FIG. 5A and FIG. 5B. As shown in FIG. 6A, the third frequency band mode 770 is a low frequency band mode having a frequency band between 2.3 GHz and 2.7 GHz. In the embodiment, the VSWR of the third frequency band mode 770 can be controlled fewer than 2. The above-identified frequency band is an exemplary portion of the actual frequency band in the third frequency band mode 770. In other words, with reference to FIG. 6A, because the third frequency band mode 770 is generated in a coupling-feed-in manner, the actual frequency band may exceed the above-identified range. Consequently, because the first frequency band mode 730 partially overlaps with the third frequency band mode 770, possible wave peaks generated in these modes may be eliminated and the VSWR may be controlled fewer than 2. Therefore, the overall frequency band may be considered as the combination of the frequency bands of the first frequency band mode 730 and the third frequency band mode 770.

Figure 6B:
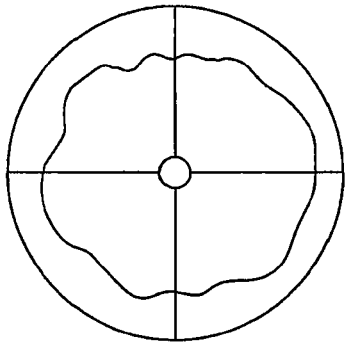
FIG. 6B shows a schematic view of a field pattern of FIG. 5A.
Figure 6B:
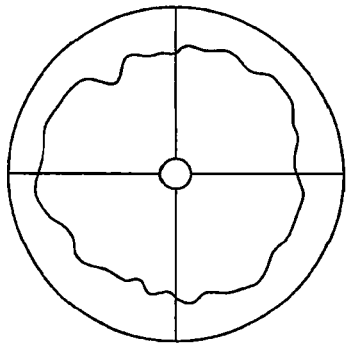
Figure 6B:
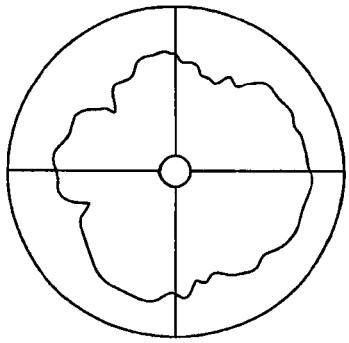

In the embodiment shown in FIG. 6A and FIG. 6B, the first frequency band mode 730 has a frequency band between 3.3 GHz and 3.8 GHz, and the field pattern of the first frequency band mode 730 is illustrated in FIG. 6B. The second frequency band mode 750 has a frequency band between 5.15 GHz and 5.85 GHz, and the field pattern of the second frequency band mode 750 is illustrated in FIG. 6B. The third frequency band mode 770 has a frequency band between 2.3 GHz and 2.7 GHz, and the field pattern of the third frequency band mode 770 is illustrated in FIG. 6B. The above-mentioned field patterns are characterized in that there is no free field effect (where a recess is formed in the field pattern and the radiation power is extremely low) in East, South, West, and, North directions.

Although the embodiments of the invention have been described herein, the above description is merely illustrative. Further modification of the invention herein disclosed will occur to those skilled in the respective arts and all such modifications are deemed to be within the scope of the invention as defined by the appended claims.

What is claimed is:

1. A wideband planar antenna, comprising:

a substrate including a first surface and a second surface opposite to the first surface;

a first radiator disposed on the first surface;

a second radiator connecting to the first radiator at a connection part, wherein the second radiator is disposed on either the first surface or the second surface;

a third radiator disposed on either the first surface or the second surface;

a ground connecting to the third radiator, wherein the ground includes a first ground part and a second ground part, the third radiator includes a shorter side and a longer side, the shorter side connects to the ground, a lengthwise direction of the shorter side is perpendicular to a lengthwise direction of the longer side, the longer side extends toward the first radiator, and the second radiator is disposed between the third radiator and the ground; and a signal source feeding a high frequency signal including a positive signal and a negative signal, wherein the positive signal is directly fed through the connection part to excite the first radiator and the second radiator to generate a first frequency band mode and a second frequency band mode respectively, and the negative signal couples with the ground to be fed into and excite the third radiator to form a third frequency band mode.

2. The antenna of claim 1, wherein the second radiator extends away from the first radiator.

3. The antenna of claim 1, wherein the third radiator extends away from the ground.

4. The antenna of claim 1, wherein the second ground part connects to the first ground part, and the second ground part and the first ground part are disposed on different surfaces of the substrate.

5. The antenna of claim 1, wherein the first radiator extends from the connection part in a direction away from the second radiator to form a bending part extending toward the ground.

6. The antenna of claim 1, wherein the first frequency band mode partially overlaps with the third frequency band mode, the first frequency band mode and the second frequency band mode are not overlapped.

7. The antenna of claim 1, wherein the connection part penetrates the substrate to connect to the first radiator on the first surface and to the second radiator on the second surface respectively.

8. The antenna of claim 1, wherein an end of the longer side is bent to extend toward the shorter side.

9. The antenna of claim 1, wherein an extending end of the first radiator is bent to be opposite to the longer side.

10. The antenna of claim 1, wherein the shorter side is distributed on the substrate in a zigzag manner.

11. The antenna of claim 1, wherein the third radiator is disposed on the second surface and extends toward the first radiator, and the first radiator and the second radiator are disposed on the first surface.

12. The antenna of claim 11, wherein the positive signal of the signal source is fed into the connection part, the negative signal couples with the first ground part, the second ground part connects to the first ground part, and the second radiator disposed on a semi-open region encircled by the longer side, the shorter side, and the ground.

13. The antenna of claim 1, wherein the first ground part, the second ground part, the first radiator, and the second radiator are disposed on the first surface, a free end of the first radiator extends away from a free end of the second radiator, the second ground part connects to the first ground part, and the second radiator is disposed on a semi-open region encircled by the longer side, the shorter side, and the ground.

14. The antenna of claim 13, wherein an end of the longer side is bent to extend toward the shorter side.

15. The antenna of claim 1, wherein the third frequency band mode has a frequency band between 2.3 GHz and 2.7 GHz, the first frequency band mode has a frequency band between 3.3 GHz and 3.8 GHz, and the second frequency band mode has a frequency band between 5.15 GHz and 5.85 GHz.

16. The antenna of claim 1, wherein the second ground part is indirectly connected to the first ground part, and the second ground part and the first ground part are disposed on different surfaces of the substrate respectively.

* * * * *